United States Patent [19]

Stirbis

[11] 4,267,771

[45] May 19, 1981

[54] SELF-ALIGNING MANDREL FOR CAN PRINTING MACHINES

[75] Inventor: James S. Stirbis, Littleton, Colo.

[73] Assignee: Coors Container Company, Golden, Colo.

[21] Appl. No.: 74,979

[22] Filed: Sep. 13, 1979

[51] Int. Cl.[3] ..... B41F 17/22

[52] U.S. Cl. ..... 101/40; 101/407 A

[58] Field of Search ..... 101/38 B, 38 A, 39, 101/40, 247, 407 A

[56] References Cited

U.S. PATENT DOCUMENTS

| | | | |
|---|---|---|---|
| 3,356,019 | 12/1967 | Zurick | 101/39 |
| 3,388,686 | 6/1968 | Cohan | 101/40 X |
| 3,710,712 | 1/1973 | Demierre | 101/39 |
| 4,037,530 | 7/1977 | Sirvet | 101/40 |
| 4,138,941 | 2/1979 | McMillin et al. | 101/40 |

*Primary Examiner*—Clifford D. Crowder

*Attorney, Agent, or Firm*—Bruce G. Klaas; Dennis K. Shelton; Richard D. Law

[57] ABSTRACT

A can printing machine of the type having a rotating assembly of mandrels contacting a rotating printing blanket for transferring decoration from the blanket to cans on the mandrels is provided with mandrel assemblies which are axially alignable with the printing blanket to permit axially uniform decoration of the cans. Each mandrel assembly comprises a rigid central member; a cylindrical sleeve mounted on the central member for receiving thereon a can to be printed; first mounting means pivotably mounting the sleeve to the central member at an axial midline of the can; and second mounting means accommodating pivoting and positioning the sleeve in a rest position to permit loading and unloading of the cans. Since the sleeve rotates relative to the central member to transfer circumferential decoration from the printing blanket to the can, the first and second mounting means permit rotation of the sleeve and rotatable pivoting. The mounting means comprise frictionless bearings, the first mounting means preferably comprising a ball bearing assembly to permit pivoting and the second mounting means comprising a needle bearing assembly resting on resilient rubber O-rings at the base of the central member for accommodating pivoting and for positioning of the sleeve.

13 Claims, 4 Drawing Figures

SELF-ALIGNING MANDREL FOR CAN PRINTING MACHINES

BACKGROUND OF THE INVENTION

The present invention relates to can printing machines and more particularly to a mandrel for holding a can during the can printing operation.

Can printing machines, especially high speed continuous can printing machines, operate by the impingement of a rotating, image-carrying blanket wheel and an oppositely rotating can carrying mandrel wheel. The blanket wheel, which is at least as wide as the length of the cans, carries a series of wet ink images circumferentially spaced on its resilient periphery. The mandrel wheel carries a series of circumferentially spaced, rotatable shaft, or mandrel, assemblies, over which cans are fitted. The cans rotate on the mandrel wheel into registry and contact with the images and surface of the blanket wheel. The cans rotate about the mandrel to circumferentially receive the image from the blanket wheel. Each mandrel generally includes structure for removing cans from or drawing cans onto the mandrel shaft. This structure may be a hollow shaft extending through the center of the mandrel and controllably connected to vacuum and/or pressurized air lines.

Conventional thinking in the design of mandrels has dictated that a mandrel be rigidly positioned relative to the mandrel wheel in order to maintain alignment between the length of the can and the blanket wheel. Any misalignment would cause the image transferred to the can to be lighter towards the bottom or the top of the can. So that the outer surface of the mandrel may spin about its central mandrel axis, ball bearings generally are placed at axial ends of a central shaft and an outer mandrel sleeve.

The foregoing mandrel structure is well known in the art. U.S. Pat. No. 3,356,019 discloses a mandrel having an outer sleeve rotatably fixed to a mandrel shaft by ball bearings at axial ends of the mandrel sleeve. Similar mandrel structure is shown in U.S. Pat. No. 4,037,530, in connection with a mandrel trip mechanism which moves the mandrel away from the blanket wheel to prevent printing of the mandrel when no can is on the mandrel. In U.S. Pat. No. 3,388,686, three axially spaced ball bearings are used between the mandrel shaft and the sleeve. The mandrel shaft is adjusted into angular relationship with the blanket wheel to counteract deflection of the mandrel shaft by pressure of the printing blanket.

It can be seen, then, that drawbacks and limitations of prior art mandrel structures involve the alignment of the mandrel for proper printing by the blanket wheel. Misalignment may occur through normal manufacturing tolerances, improper alignment of the mandrel shaft, or deflection of the mandrel shaft. Another source of misalignment is slop or play in the other parts of the mandrel structure, particularly in relatively complex mandrel structures such as those employing a trip mechanism.

SUMMARY OF THE INVENTION

The present invention provides a self aligning mandrel for providing axially uniform pressure between a can on a mandrel and the blanket wheel. The present mandrel structure comprises an outer sleeve which is axially pivotable through 360° about a circular midline axially positioned about midway between the top and bottom of the can.

The present mandrel structure is specifically intended for use with two-piece, drawn-and-ironed cans, which must be printed as cylinders. Any tubular or open-ended cylindrical object may be printed on the present mandrel structure, however, and it is intended that the term "cans" as used herein encompass such objects.

The present mandrel structure comprises a support member in the form of a generally cylindrical central shaft member fixed on the printing machine, a generally cylindrical sleeve circumferentially surrounding the central shaft member and supporting and positioning thereon a can having an axial length, and mounting means between the sleeve and the central shaft. The present mounting means provides rotatable and pivotable mounting between the sleeve and the central shaft whereby a can on the sleeve can be pivoted about its axial midline for even pressure along its entire length as it rotates in peripheral contact with the blanket wheel. The mounting means are also provided to position the sleeve in a rest position for loading and unloading cans on the sleeve. The mounting means are constructed to permit a controlled amount of pivoting determined by the amount of play in the mandrel assembly. The mounting means preferably comprise frictionless bearings, i.e., bearings having rolling elements, such as ball bearings, needle bearings, roller bearings, etc. Ball bearings, which provide pivotable mounting through movement between an inner and an outer race, are mounted between the central shaft and the cylindrical sleeve at the axial midline of a can on the sleeve to provide pivoting. To accommodate pivoting and provide a rest position, needle bearings, which are roller bearings having a length at least four times their diameter, are mounted axially from the ball bearings against resilient rubber 0-rings which permit axial movement of the sleeve relative to the central shaft.

DESCRIPTION OF THE PREFERRED EMBODIMENT

In General

Figure 1:
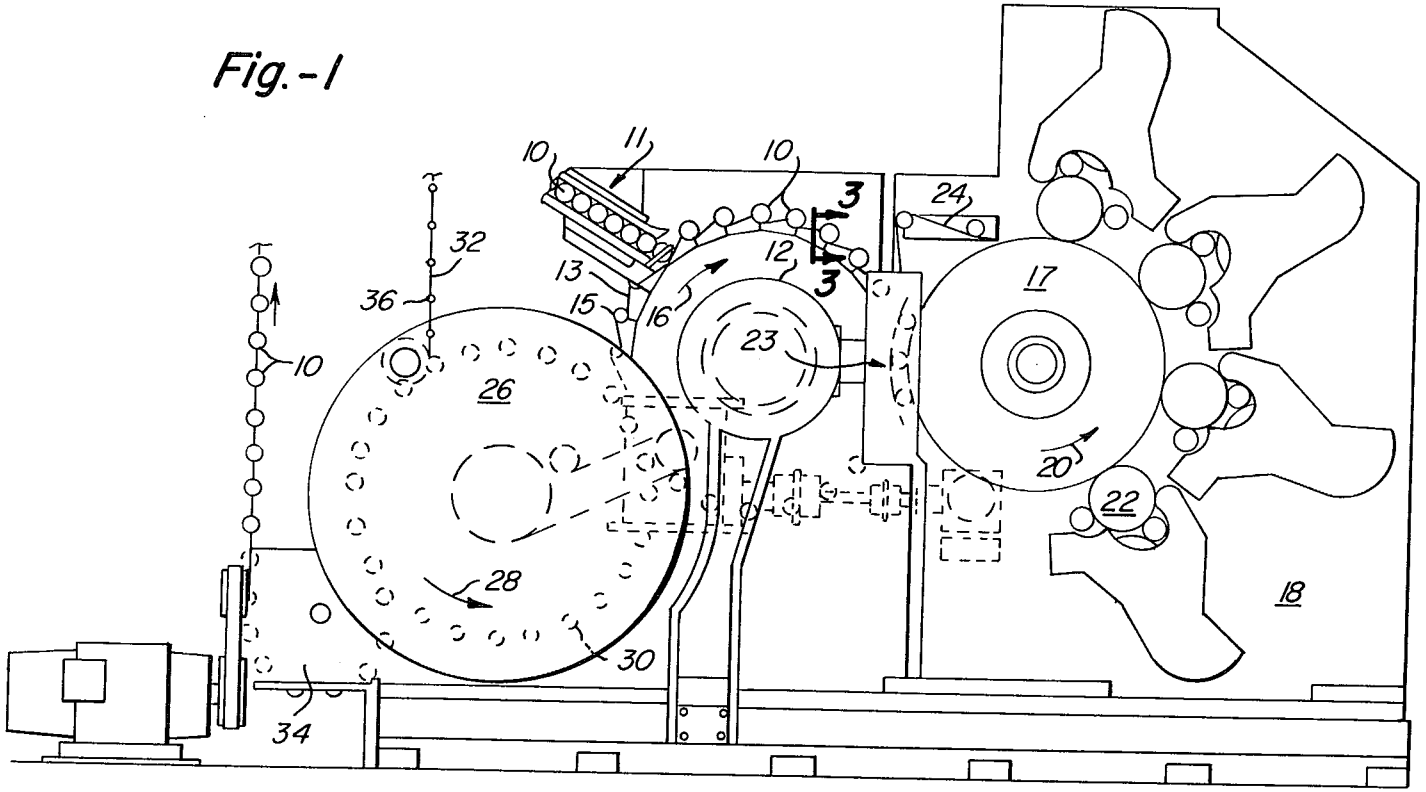
FIG. 1 is a side view of a can printing machine employing a mandrel assembly of the present invention.

Referring now to FIG. 1, a conventional high speed continuous can printer is shown wherein cans 10 are fed through an infeed chute 11 to a pocket wheel 12 comprising a plurality of pockets 13, each having a concave semi-cylindrical surface in which cans rest and are retained by gravity. Behind the pocket wheel 12, in coaxial relationship therewith, is a mandrel wheel assembly bearing a plurality of mandrel assemblies 15 which approximate the internal diameter of the cans 10 and which are aligned with the pockets 13 of the pocket wheel 12 so that cans may be slid from each pocket onto a corresponding mandrel by angled fingers and a burst of compressed air. Cans are held against the mandrel sleeves by vacuum applied through the mandrel. Each mandrel and can thereon rotates continuously with the mandrel wheel assembly in a generally circular path of travel in the direction of arrow 16 to the vicinity of a printing blanket wheel 17 mounted in radial opposition to the mandrel wheel on a machine stand 18. The blanket wheel 17 is driven in the direction of arrow 20 opposite to the direction of arrow 16 and carries on its periphery a smooth, segmented rubber printing blanket bearing wet reverse ink images to be transferred to the cans. The width of the printing blanket corresponds to the length of the cans. The ink images are placed on the blanket wheel by inking rollers 22 mounted on the machine stand 18, there being one set of inking rollers for each color contained in the ink image. In the vicinity of the blanket wheel, the mandrels 15 depart from their circular path of travel and move in a path defined by a cam track in a concave path shown in exaggerated form at 23, which corresponds to the circumference of the printing blanket. Each mandrel assembly 15 comprises a rotatable mandrel sleeve which permits rotation of the can thereon relative to the printing blanket to receive complete circumferential decoration of the can by the blanket. As a can moves towards the vicinity of the printing blanket wheel, a moving prespin belt 24 engages the mandrel sleeve to cause it to rotate in the direction and at the speed required by the movement of the printing blanket. The printing operation involves contact between the rotating can and a segment of the printing blanket during mandrel movement along the concave portion 23 of the mandrel assembly track.

During the printing operation, a can may be dented or for some other reason not properly seated on a mandrel sleeve. In order to prevent contamination of a bare mandrel sleeve with ink from the printing blanket, a "skip print" mechanism is provided to prevent contact of a bare mandrel sleeve with the printing blanket. For the preferred embodiment of the present invention, a skip print mechanism is used as described in U.S. Pat. No. 4,037,530, wherein the mandrel arm pivots slightly away from the blanket wheel on signal from an electronic sensor and as further described in connection with FIG. 2.

After printing, the cans 10 again follow a circular path of travel at the periphery of the mandrel wheel to a transfer mechanism such as a continuously rotatable transfer wheel 26 mounted for rotation in the direction of arrow 28 parallel to the mandrel wheel and comprising a peripheral array of transfer devices, such as suction cups 30 extending axially towards the mandrels and rotating in cooperation therewith to pass oppositely of the mandrels. The transfer devices 30 are carried on the transfer wheel 26 to an output conveyor chain 32 powered by a chain drive 34 and comprising a plurality of pins 36. The pins 36 extend from the chain towards the cans on the transfer wheel and are spaced and arranged so that each pin enters a can on the transfer wheel and supports the can upon removal of suction from the suction cups 30. The cans 10 on the pins 36 move away from the suction cups and the transfer wheel and are carried to a drying oven for further handling.

Mandrel Arm Assembly

Figure 2:
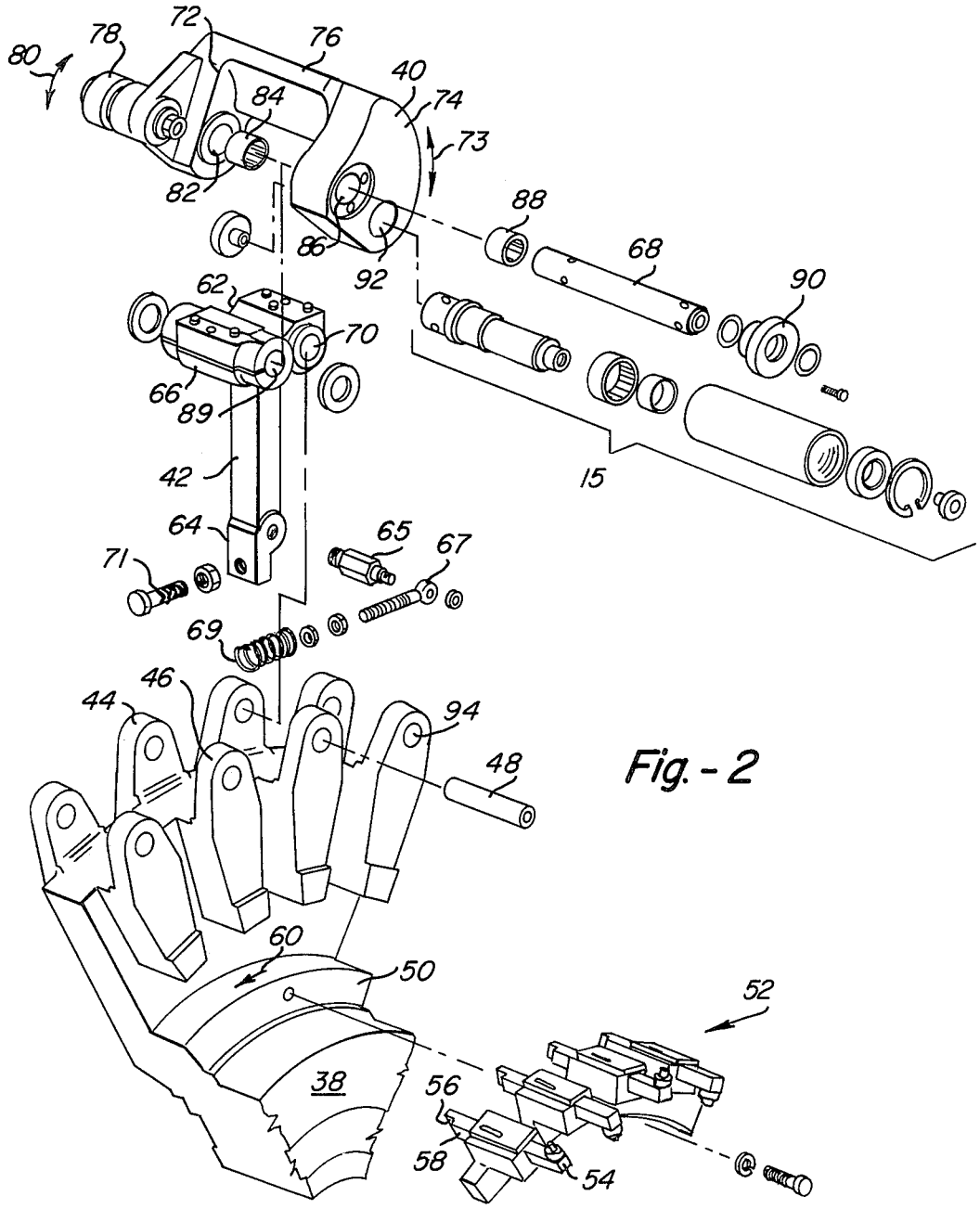
FIG. 2 is an exploded view of the mandrel assembly.

Referring now to FIG. 2, a mandrel wheel assembly is shown in conjuction with a portion of a central hub or turret wheel 38 mounted coaxially with pocket wheel 12 and supporting a mandrel assembly 15 through a pivotal mandrel holder 40 and a pivotable mandrel arm 42, there being a plurality of mandrel assemblies circumferentially spaced about the turret wheel.

The turret wheel 38 comprises a pair of radially outermost, outwardly extending ear portions 44, 46 having a pair of aligned apertures for support of a shaft 48 for holding the mandrel arm 42. The turret wheel 38 further comprises an axially and circumferentially extending shoulder portion 50 located radially inward of the ear portions. A movable stop block assembly 52 is mounted to a radial surface of the lip portion and comprises a cylinder-operated, axially movable positioning block 54 comprising a first lateral surface 56 and a second lateral surface 58 spaced therefrom in a circumferential relationship relative to the turret wheel 38 as indicated by arrow 60.

The pivotable mandrel arm 42 comprises a radially extending arm portion terminating outwardly in a head portion 62 and inwardly in a tip portion 64 having a planar surface opposite the lateral surfaces 56, 58 of the positioning block 54. The head portion 62 comprises a split sleeve 66 for receipt of a mandrel holder shaft 68 and a parallel bore 70 for connection with the shaft 48. The tip portion 64 of the mandrel arm 42 bears axially and circumferentially extending threaded connectors 65, 67 connected to a coil spring 69 which is compressed against the turret wheel to pivotally urge the mandrel arm in a direction opposite of that of arrow 60 towards one of the surfaces 56, 58 of the stop block 54. A screw 71 is adjustably threaded through the tip portion 64 of the mandrel arm to engage the surfaces 56, 58 of the stop block 54.

The mandrel arm 42 is pivoted about the support shaft 48 by extension and retraction of the stop block 54, which displaces the screw 71 and the mandrel arm 42. Extension and retraction of the stop block 54 is carried out in response to an electronic sensor detecting the presence or absence of a can on the mandrel assembly 15. Pivoting the mandrel arm 42 displaces the mandrel holder 40 in the direction of arrow 73 to radially displace the mandrel assembly 15 a small distance to prevent contact between the mandrel assembly and the printing blanket in the absence of a can on the mandrel.

The mandrel holder 40 comprises two opposing rear and forward plate portions 72, 74 joined by a connecting portion 76. The rear plate portion comprises a rearwardly extending cam roller 78 which is generally cylindrical and rides in a cam track (not shown) which directs the cam in the direction of arrow 80 to pivot the mandrel holder about the mandrel holder shaft 68 and create the previously described concave track 23 of the mandrel. The rear plate 72 further comprises a bearing socket 82 for containing a roller bearing 84 which supports a rear portion of the holder shaft 68. The forward plate portion 74 comprises an aperture 86 for support of roller bearing 88 and the forward portion of the holder shaft 68. The holder shaft 68 is retained in the mandrel holder 40 by a flanged end piece 90 and extends through the pivot arm sleeve 66 through aperture 89 to pivotally support the mandrel assembly on the pivot wheel. The forward plate portion 74 further comprises an aperture 92 for support and receipt of the mandrel assembly 15 which extends forwardly therefrom.

From the foregoing description of the support structure for the mandrel assembly 15, it can be seen that numerous tolerances and inaccuracies may interfere with the axial alignment of the mandrel assembly. The positioning of the mandrel assembly 15 in its support aperture 92 in the mandrel holder will naturally affect its alignment. In addition, the support and holder apertures 82, 86, 92 in the mandrel holder may not be parallel. The size and location of the apertures in the turret wheel ears 44, 46 may skew the mandrel holder 40 by angling the holder shaft 48. The internal and external diameter of a bushing 94 used in the apertures may also skew the mandrel holder shaft 48. The position of the stepped surfaces 56, 58 on the positioning block 54 affect the pivotal position of the arm 42. The adjustment of the screw 71 abutting the stepped surfaces 56, 58 also affects the pivotal mandrel position.

The Mandrel Assembly

Figure 3:
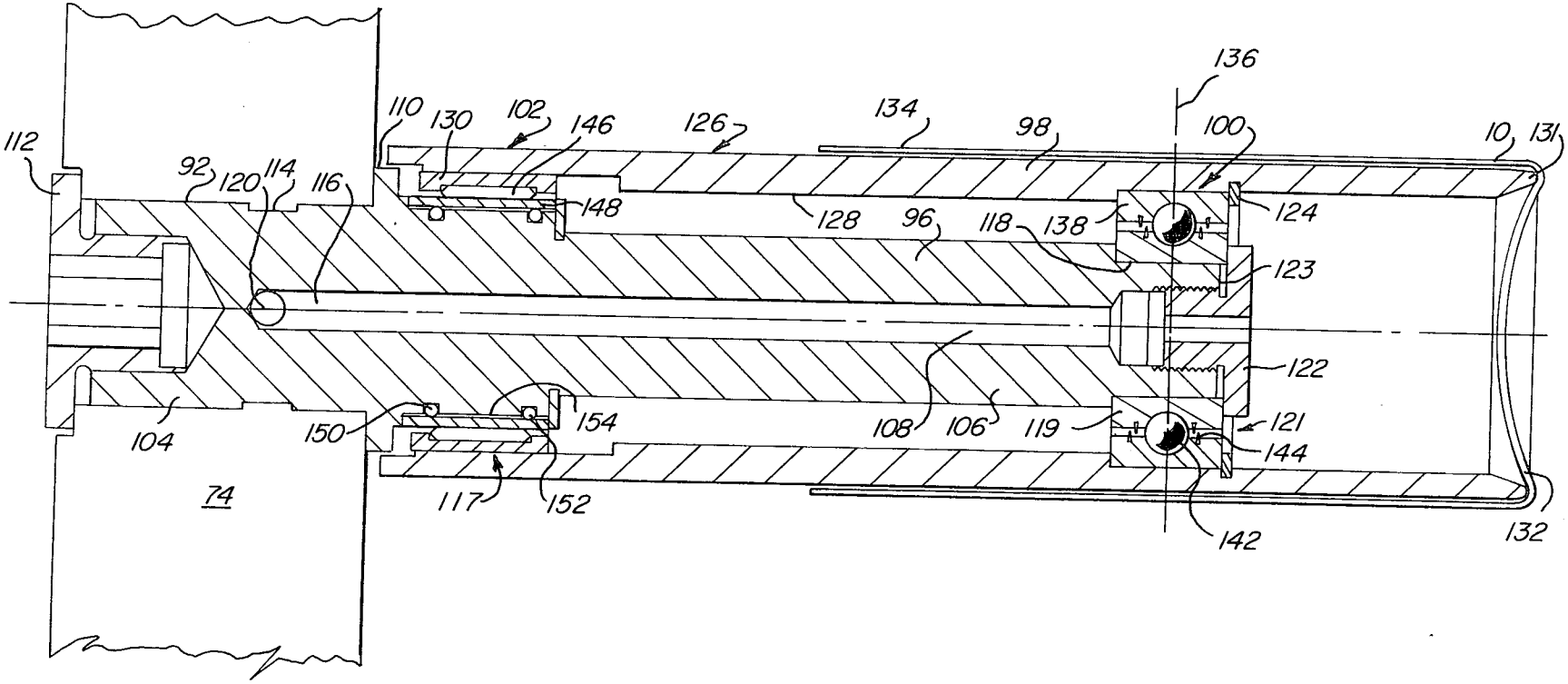
FIG. 3 is a side sectional view of the mandrel assembly taken along line 3—3 of FIG. 1.

The present mandrel assembly 15, as shown in FIG. 3, comprises a central shaft 96 and a cylindrical sleeve 98 surrounding the shaft and supported on the shaft by a first mounting means 100 pivotally mounting the sleeve and a second mounting means 102 positioning the sleeve in a rest position. The amount of pivoting through which the sleeve 98 can move is controlled by the mounting means to accommodate the tolerances previously described.

The central shaft 96 comprises a rearward stub portion 104 and an axially forwardly extending sleeve support portion 106 extending substantially the length of the sleeve 98 for greater support of the sleeve. A central fluid passage 108 extends axially from the stub portion through the sleeve support portion. The rearward stub portion 104 extends through the forward plate portion 74 through support aperture 92 and is secured thereto by a cylindrical flange portion 110 abutting the forward surface of the plate portion and a draw nut 112 threaded into a rear surface of the stub portion and abutting a rear surface of the forward plate portion. The stub portion is also keyed into the plate portion by a cylindrical groove 114 extending perpendicularly to a central longitudinal axis 116 of the mandrel assembly 15 and the central shaft 96. The sleeve support portion 106 is generally cylindrical, comprising an axially outwardly stepped portion for support of the second mounting means, which is a needle bearing assembly 117. The forwardmost portion of the central shaft 96 comprises an annular, inwardly stepped portion 118 having a perpendicular rear side wall to snugly receive an inner race 119 of a first mounting means, a ball bearing assembly 121, perpendicular to the central axis 116. The fluid passage 108 extends from a rearward aperture 120 in the stub portion leading to a vacuum source through a forwardmost surface 123 of the central shaft portion. The forwardmost surface 123 comprises a central cavity to receive an end nut 122 which serves to retain the inner race 119 of the first mounting means ball bearing assembly 121.

The sleeve member 98 is generally tubular, having a smooth cylindrical outer surface 126 over which, in operation, a can 10 is slidably supported. The inner cylindrical surface 128 is generally parallel to the outer surface 126 and spaced from the central shaft 96. A retaining ring 124 is held on a slot in the inner surface 128 of the mandrel sleeve 98 to axially force the outer race of the ball bearing assembly 121 against the rear wall of the recess 118 in the sleeve to position the outer race perpendicular to the central axis 116. At the rearward portion, the sleeve 98 is stepped axially outwardly from axis 116 to engage an outer race 130 of the needle bearing assembly 117. Forwardly of the ball bearing assembly 121, it is stepped outwardly to receive the ball bearing during assembly and secure it against rearward force applied by the retaining ring 124. At its forwardmost portion, the inner surface is tapered outwardly to a rounded shoulder surface 131 which corresponds to an end wall portion 132 of the can 10 and securely seats the can in a predetermined position.

The predetermined position of the can 10 is such that it is held with its side wall portion 134 flush against the sleeve surface 126 by vacuum through passage 108 and it is further drawn axially inwardly by the vacuum so that its axial position, determined by the sleeve shoulder surfaces 131, 132, defines a circular midline 136 passing midway between the top and the bottom of the can 10 and midway through the first mounting means 100.

The first mounting means 100 comprises the ball bearing assembly 121, which is a conventional ball bearing having inner race 119, seated in the central shaft, an outer race 138 seated in the sleeve member 98, and a plurality of spherical balls 142 held between the races. Small plate members 144 may be provided to prevent dust from entering the faces. The spherical configuration of the balls 142 permits a certain amount of rocking between the inner and outer races 119, 138 to provide a pivoting action through 360° about the circular midline 136.

The second mounting means 102 comprises the needle bearing assembly 117 which is a conventional needle bearing having outer race 130 retaining a plurality of cylindrical needles 146 facing axially parallel to centerline 116 to ride on an inner race 148. While ball bearings or other bearings could be used in the second mounting means, needle bearings are preferred as being more compact and easier to assemble, with greater axial tolerance. The outer race 130 is pressed into the stepped portion of the inner surface 128 of the sleeve 98. The inner race 148 is supported by a pair of axially spaced resilient rubber 0-rings 150, 152 fitted into grooves around a cylindrical surface 154 of the central shaft. The 0-rings extend beyond the surface 154 so that the resilient nature of the 0-rings determines the rest position of the mandrel sleeve and spaces the central shaft a predetermined distance from the inner surface of the inner race 148. The predetermined distance between the surface 154 bearing the 0-rings 150, 152 and the inner surface of the inner race 148, resting on the 0-rings, determines the amount of pivoting movement of the sleeve 98. The rest position defined by the 0-rings aligns the mandrel sleeve 98 with central axis 116. In the case of the above described tolerances, this distance is 0.008 in. (0.2 mm.). This distance, while relatively small, could be made less in the case of more accurately positionable mandrel assemblies, or it could be made much greater, to the extent that can i.d. exceeds sleeve o.d., without affecting can loading and unloading operations, the main practical limitation being the need to recover alignment skewed by the prespin belt 24.

Numerous variations of the foregoing arrangement are possible. Other frictionless bearings than those described may be used. 0-rings 150, 152 may be placed between the outer race 130 of the second mounting means 102 and the sleeve 98. The rolling elements of the second mounting means could then ride directly on a heat treated ground portion of the central shaft. Pivotable first mounting means may be provided by rounding an outer race of a frictionless bearing or crowning the mandrel sleeve to rock against the outer race.

Alternative Mandrel Assembly

The previously described mandrel assembly is preferred as being easily adaptable to prior art mandrel assemblies. However, many variations are possible utilizing the present inventive concepts in entirely new designs.

Figure 4:
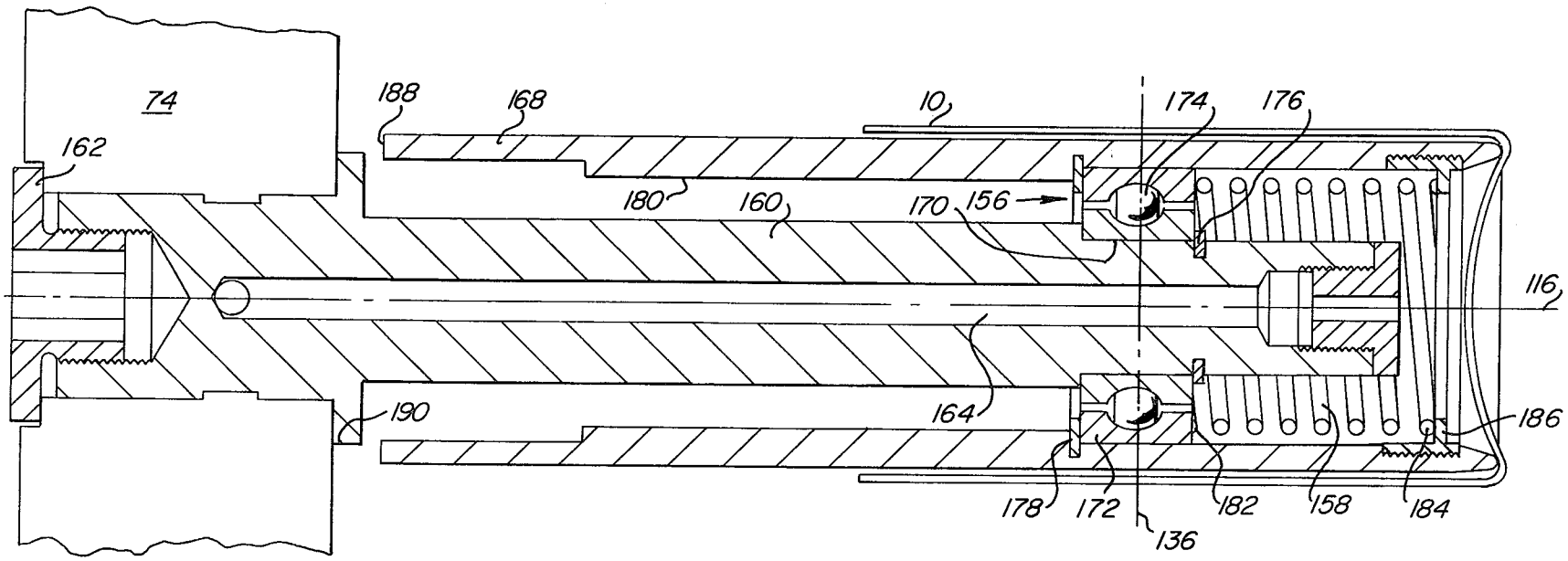
FIG. 4 is a side sectional view of an alternative embodiment of the mandrel assembly of FIG. 3.

One such variation, as shown in FIG. 4, utilizes a first mounting means comprising a spherical bearing assembly 156 and a second mounting means comprising a coil spring 158. The mounting means are comprised in a mandrel assembly as previously described, with a central shaft 160 connected through end nut 162 to a forward plate portion 74, having a central fluid passage 164. The mandrel sleeve 168 is substantially similar to that previously described, supporting a can 10 and being radially spaced from the central shaft 160.

The spherical bearing 156 provides both radial and axial bearing support, being the only contact between the sleeve and central shaft, and provides pivoting movement about 360° in a circle lying diametrically along the midline 136. It comprises a standard spherical bearing having an inner race 170, an outer race 172 spaced therefrom, and ellipsoid rolling elements 174 between the races. The inner race 170 is slid rearwardly onto the central shaft 160 to abut rearwardly a perpendicular stepped surface of the central shaft. The inner race 170 is held axially by a snap ring 176 fitted in a groove in the central shaft and is held flush radially with the central shaft by the rolling elements 174. The outer race 172 is slid rearwardly against the cylindrical inner surface 180 of the sleeve 168 to abut a retaining ring 178 set in an inner surface of the sleeve 168. The outer race 172 is held radially flush against the sleeve by the rolling elements 174 and is urged rearwardly by the coil spring 158.

The coil spring 158 has its axial end coils 182, 184 turned and ground as is known in the art to make these end coils approximately parallel and perpendicular to the central axis of the spring. The coil spring thereby rearwardly exerts uniform circumferential pressure. When in position, coaxial with central mandrel axis 116, it may be compressed axially along any line about its circumference by the angling of the mandrel sleeve 168, and it will expand to align the mandrel sleeve parallel to the central axis 116 by virtue of its uniform compression characteristics and uniform force exerting configuration of the parallel ends. The spring 158 is slightly less in diameter than the internal diameter of the forward portion of the sleeve 168 into which the spring is slid during assembly to abut the forward surface of the outer race 172 of the spherical bearing. The spring is compressed slightly by a locking ring 186 outwardly engaging a threaded forwardmost portion of the inner surface 180 of the mandrel sleeve 168 and threaded rearwardly into the mandrel sleeve.

The rearward portion 188 of the inner surface of the mandrel sleeve 168 is spaced a distance from an outward surface 190 of the central shaft 160 to provide free pivoting through which the sleeve can move. As can be seen in FIG. 4, the sleeve is pivotable about the central shaft by angling of the inner and outer races 170, 172 of the bearing assembly. Limitation of the pivoting movement is controlled by maximum compression of the spring 158.

Other spring assemblies could also be used for the second mounting means, such as an array of radially extending springs extending from a rotatable bearing on the central shaft to the mandrel sleeve.

While particular embodiments of the present inventive concepts have been disclosed herein, it is to be understood that many of the inventive concepts can be carried out by other components and arrangements than those particularly described. Thus, it is intended that the appended claims be construed to include alternative embodiments except insofar as limited by the prior art.

What is claimed is:

1. Apparatus for supporting a can during printing of the can by a printing machine having blanket means for applying pressure to the can to transfer printing to the can, comprising:

a rigid support member fixed on said printing machine;

a generally cylindrical sleeve circumferentially mounted on said support member in generally coaxial relationship therewith;

said sleeve supporting and receiving thereover in a predetermined position a generally cylindrical can, said can having an axial length;

first mounting means for rotatably pivotably mounting said sleeve relative to said support member to permit pivoting of said sleeve relative to the support member between a rest position whereat said sleeve and said support member are coaxial and variable pivotally displaced non-coaxial positions relative to said support member;

said first mounting means being located in the vicinity of the mid-portion of said axial length of a can supported on said sleeve; and second mounting means for rotatably, resiliently mounting said sleeve relative to said support member for positioning said sleeve in the rest position.

2. The apparatus of claim 1 wherein said support member comprises a central shaft extending along a substantial length of the sleeve.

3. The apparatus of claim 2 wherein said central shaft comprises a fluid passage for drawing said can against said sleeve, thereby permitting support of a can having an internal diameter greater than an external diameter of said sleeve.

4. The apparatus of claim 1 or 2 or 3 wherein said second mounting means comprises:

bearing means axially spaced from said first mounting means; and

O-ring members between said bearing means and said support member for providing resilient, pivotal movement between said sleeve and said support member.

5. The apparatus of claim 1 or 2 or 3 wherein said first mounting means comprises:

bearing means having an inner race fixed to said support member, an outer race in slightly spaced relationship from said inner race, fixed to said sleeve, and bearings between said inner race and said outer race which permit pivoting by changing said spaced relationship.

6. The apparatus of claim 5 wherein said second mounting means comprises roller bearings.

7. The apparatus of claim 6 wherein said roller bearings are needle bearings.

8. The apparatus of claim 6 wherein said roller bearings are positioned between said support member and said sleeve by resilient 0-rings which permit deflection and return said sleeve to the rest position.

9. The apparatus of claims 1 or 2 or 3 wherein said second mounting means comprises spring means exerting circumferentially uniform force between said sleeve and said first mounting means.

10. The apparatus of claim 9 wherein said spring means engages said sleeve and a portion of said first mounting means fixed on said sleeve.

11. The apparatus of claim 9 wherein said first mounting means comprises a ball bearing assembly.

12. The apparatus of claim 9 wherein said first mounting means comprises an ellipsoid roller assembly.

13. The apparatus of claim 9 wherein said spring means comprises:

a compression spring member mounted circumjacent said support member.

* * * * *